United States Patent [19]

Stokes et al.

[11] 4,313,605

[45] Feb. 2, 1982

[54] COMPETITION GAME MACHINE

[76] Inventors: W. Fred Stokes, Rte. 2, Branchville, S.C. 29432; Fairey S. Bradford, 909 4th Ave., Kingstree, S.C. 29556; Nancy S. Strobel, 901 Wisteria Dr., Florence, S.C. 29501

[21] Appl. No.: 184,467

[22] Filed: Sep. 5, 1980

[51] Int. Cl.[3] ..... A63F 7/06; A63F 7/10

[52] U.S. Cl. ..... 273/85 C; 124/5; 273/357

[58] Field of Search ..... 273/85 R, 85 C, 85 D, 273/85 E, 85 F, 85 G, 119 R, 357

[56] References Cited

U.S. PATENT DOCUMENTS

| | | | |
|---|---|---|---|
| 935,585 | 9/1909 | Campbell | 273/85 E |
| 1,319,372 | 10/1919 | Biertuempfel | 273/85 C |
| 1,827,885 | 10/1931 | Emenhiser | 273/357 X |
| 3,537,707 | 11/1970 | Goldberg | 273/85 D X |
| 3,901,508 | 8/1975 | Spangler | 273/85 C |
| 3,947,031 | 3/1976 | Goldfarb et al. | 273/85 E X |
| 3,977,675 | 8/1976 | Leuthy | 273/85 D |
| 4,119,315 | 10/1978 | Goldfarb et al. | 273/85 F |

FOREIGN PATENT DOCUMENTS

| | | | |
|---|---|---|---|
| 512456 | 7/1952 | Belgium | 273/85 D |
| 1114892 | 12/1955 | France | 273/85 E |

*Primary Examiner*—George J. Marlo

*Attorney, Agent, or Firm*—Watson, Cole, Grindle & Watson

[57] ABSTRACT

A game machine which can be played by two or more players includes an elongated box-like housing in which a game ball can be inserted, the housing including elongated side members with transparent viewing windows therein and opposed end members with openings in their upper portions through which the game ball can be projected to achieve a score. The housing also includes at least three transversely extending flooring panels stationarily mounted in spaced apart fashion between the housing end members, the upper portions of these flooring panels forming separated segments of a playing deck surface for the game ball. Two projector elements which are operable by respective competing game players are positioned at respective opposite ends of the housing, each projector element including a transversely extending curved head portion which not only forms a segment of the playing deck surface between the adjacent housing end member and the nearest flooring panel, but which, when the associated portion of the projector element located outside the housing is manually operated, can also be moved to project a game ball therein towards the opposite housing end member. At least two activator elements which are operable by competing game players are positioned in the housing between the projector elements, each activator element including a transversely extending contact element which not only forms a segment of the playing deck surface between adjacent flooring panels, but which, when the associated portion of the activator element located outside the housing is manually operated, is rotatable about an axis extending transversely to the housing to contact and move a game ball in a desired fashion within the housing.

9 Claims, 9 Drawing Figures

COMPETITION GAME MACHINE

BACKGROUND OF THE INVENTION

1. Field of the Invention

The present invention is directed to a portable game machine comprised of an elongated housing in which a game ball can be inserted and then moved towards a goal located at either end based on suitable manipulation of elements within the machine by two or more competing game players positioned on either side of the housing. The present invention is related to the invention described and claimed in the applicants' copending application Ser. No. 161,450, filed June 20, 1980.

2. The Prior Art

Competitive game machines that comprise a housing in which a projectile can be moved towards opposite ends by the manipulation of elements within the housing are well known. Many of these game machines are constructed such that when played they will simulate the playing of a basketball game.

One known game machine which can be used by a single player to play a type of game which represents a combination of simulated basketball, golf and skeeball is shown in U.S. Pat. No. 3,537,707 (Goldberg). This device comprises an elongated housing which has a basket-like goal mounted on one housing end wall and which includes a throwing device mounted to extend between and through slots in the side walls of the housing near the opposite housing end wall. The throwing element comprises a rotatable shaft and a holding member fixedly mounted to its center, the holding member including a sloping lip for cupping a game ball. The ends of the rotatable shaft are separately translatable along the side wall slots, and the shaft is also freely rotatable so as to cause the holding member to project a game ball positioned in the holding member towards the basket-like goal. The game ball can be picked up from the smooth, inclined base of the device by both the appropriate sideways or translatable movement of the rotatable shaft, as well as its timely rotation.

A somewhat more complicated game machine is shown in U.S. Pat. No. 3,977,675 (Leuthy). In this device, which can be played by two or more players, an elongated housing has identical barriers positioned near the opposite housing end walls (the barriers having a lesser height than the housing end walls) to form goal areas therebehind (each barrier including a goal opening in its lower side located in contact with the flat floor 4 of the housing), and also positioned therein between the barriers are multiple projector elements. Each of the projector elements comprises an elongated rotatable shaft which extends between and through holes in the housing side walls, and a plurality of paddles are fixedly connected to each rod, each paddle being capable of contacting and projecting a game ball inside the housing towards either barrier, e.g., either along the housing floor or in the air, depending on how it is manipulated.

A much differently constructed game machine is shown in U.S. Pat. No. 3,947,031 (Goldfarb et al). In this device, which comprises a very narrow elongated housing in which a game disk is projected towards baskets located on the opposite housing end walls, a number of player character-figures and two goalkeeper character-figures are positioned in the housing to manipulate and control the movement of the game disk. Each player character-figure is not only vertically movable, but each includes oppositely directed arms which are separately pivotable around separate pivot pins attached to the head section, with each arm being connected via a linkage system to a lever handle located on the outer side of opposite housing side walls. These arms (which overlap in the longitudinal dimension of the housing with the arms of the next adjacent player character-figure) effectively form the floor of the game machine. Separate linkage systems operable by game players on opposite sides of the game machine can cause the opposing goalkeeper character-figures to rise and fall within the housing and thus, by way of a vertically-extending arm portions thereof, block the entry of the game disk into the adjacent basket.

It is an object of the present invention to provide a competition game machine which is portable, which is operable without batteries, which will be constructed so as to help the players thereof develop coordination, timing and other skills often obtained only in actual physical sports participation, and which can have its operating characteristics easily modified, for example, by changing the size and weight of the game ball used therein, by changing the shapes of the various elements inside the machine which contact the game ball, or by mounting a net inside the machine to extend from side-to-side and thus drastically alter the technique required for moving a game ball from one end of the machine to the other.

SUMMARY OF THE PRESENT INVENTION

In accordance with the present invention the competition game machine includes an elongated, generally box-like housing composed of an elongated cover member, two elongated side members, two end members and an elongated bottom member, and operatively positioned within the housing are movable elements which can be individually operated by competing players positioned on opposite sides of the housing so as to move a game ball towards either one end member of the housing or the other. Each housing end member includes an opening in its upper portion through which a game ball may pass so as to constitute a score for the appropriate game player, and each side member includes an elongated opening in which a transparent window is positioned. A game ball return device is mouned on the outer side of each end member to convey a game ball passed through the adjacent end member opening to a location where it can be easily retrieved by the opposing game player, and the cover member includes a centrally located opening for the introduction of a game ball into play within the housing.

The housing also includes at least three transversely extending flooring panels which are mounted in spaced apart fashion between the housing end members, the upper portions of these flooring panels forming separated segments of a playing deck surface located above the housing bottom (the playing deck surface functioning as the bottom of the game ball playing zone within the housing).

Operatively positioned at opposite ends of the housing are separate projector elements which are respectively operable by competing game players, each projector element including a curved head portion which extends transversely of the housing and which not only forms a segment of the playing deck surface between the adjacent housing end member and the nearest flooring panel, but which can be caused to move and project a game ball therein towards the opposite housing end member. Each projector element includes a rotatable shaft that extends through aligned openings in the housing side members to which the curved head portion is connected, and each rotatable shaft includes a handle near the end thereof outside the housing to provide for manual gripping and rotation, the handles on the rotatable shafts of the opposite projector elements being located on the outer sides of the opposite side members of the housing (to allow for their respective operation by the competing game players).

Also operatively positioned in the housing between the two projector elements are at least two rotatable activator elements which are respectively operable by competing game players, each activator element including a contact member which extends transversely of the housing and which not only forms a segment of the playing deck surface between adjacent flooring panels, but which can be caused to rotate essentially in place along an axis extending transversely of the housing to contact and move a game ball in a desired fashion. Each activator element also includes a yoke formed of two arms and a cross bar connecting first ends thereof (the cross bar rotatably extending through aligned openings in the housing side members such that the arms thereof are located on the outer sides of opposite side members), and a rotatable shaft extends through aligned bores in the second ends thereof, the rotatable shaft extending through and being translatable along aligned crescent-shaped slots in the housing side members. The contact member will be slidingly positioned around the rotatable shaft along a center portion thereof between the housing side members, and the contact member will include separate control means connected between its opposite ends and the adjacent housing side members such that when the rotatable shaft is translated along the crescent-shaped slots in the housing side members, the contact member will rotate essentially in place. A rotatable knob is connected to the end of the rotatable activator shaft outside the housing to provide for manual gripping and movement, the knobs on the rotatable activator shafts of adjacent activator elements being located on the outer sides of the opposite side members of the housing (to allow for their respective operation by the competing game players).

Further objects, advantages and features of the present invention will be apparent in the arrangement and construction of the constituent parts in detail as set forth in the following description taken in conjunction with the accompanying drawings.

DETAILED DESCRIPTION OF THE PREFERRED EMBODIMENT

Figure 1:
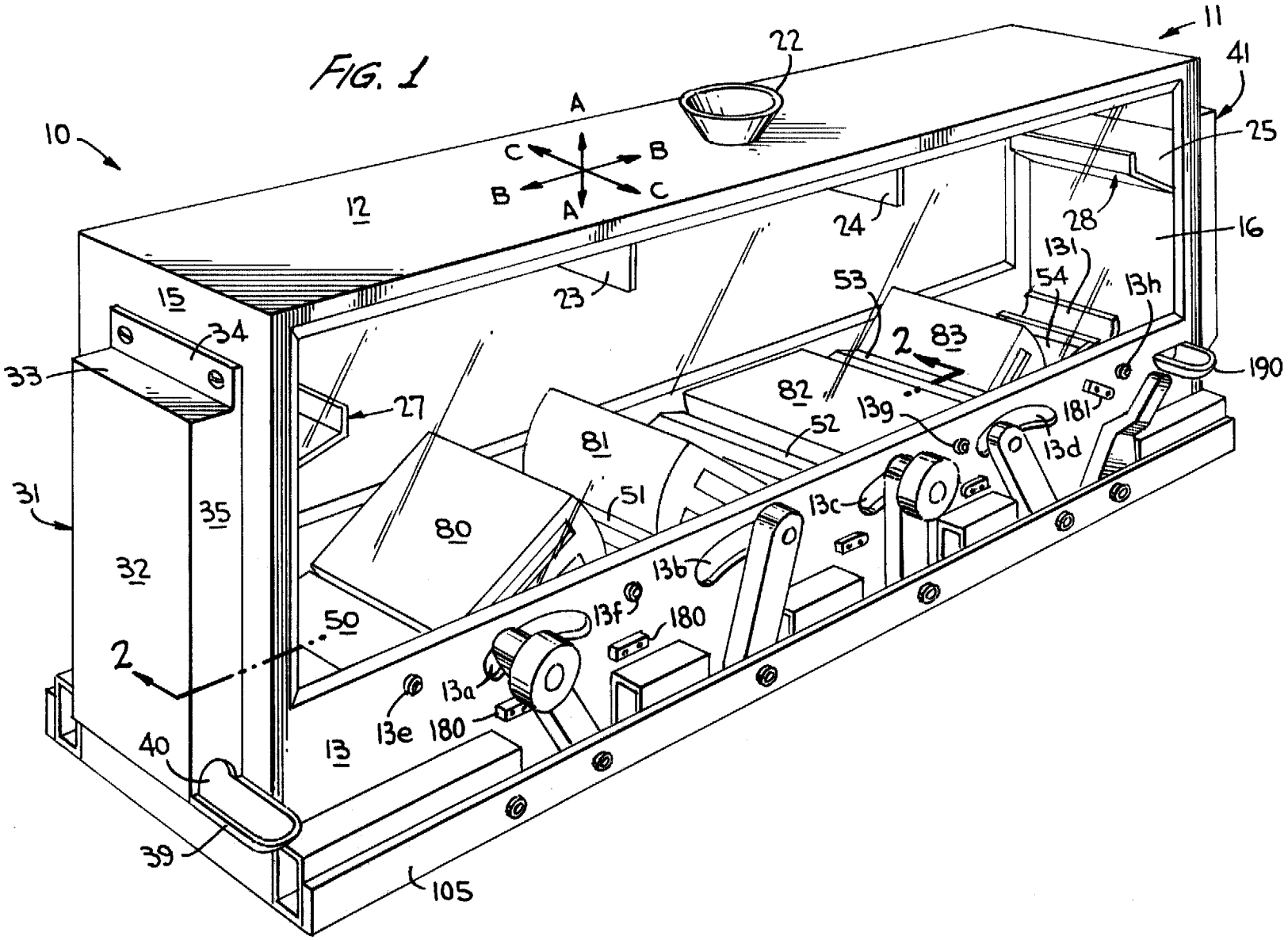
FIG. 1 shows a perspective view of the preferred embodiment of competition game device constructed in accordance with the present invention.

The preferred embodiment of competition game machine constructed in accordance with the present invention is shown in a perspective view in FIG. 1. This machine, labeled 10, is seen to have an overall elongated, generally box-like shape, which allows it to operate on any flay and horizontal supporting surface, such as a table top. At the same time, the machine will have a sufficient weight that it will remain essentially stationary when the movable components therein are being manipulated during the course of competitive operation of the machine. Thus, the various components of the machine can be made of either metallic materials and/or impact-resistant plastics, although impact-resistant plastic such as polypropylene and polystyrene are preferred due to their easy moldability, low cost and high durability.

Considering the machine 10 in more detail, its basic design is created by a housing 11 which is formed by an elongated rectangularly-shaped cover member 12, two opposed elongated rectangularly-shaped side members 13 and 14, two opposed rectangularly-shaped end members 15 and 16, and an elongated rectangularly-shaped bottom member 17. These members are connected to each other at their various side edges by suitable means such as screws (not shown). It is within housing 11 that the manipulation of the game ball will take place. In the following discussion the terms "inner" or "inwardly" and "outer" or "outwardly" will refer to whether or not the surfaces of the associated structural elements will face towards or away from the inside of the housing 11, the terms "upwardly" and "downwardly" will refer to the directions of the associated structural elements along line A—A as shown in FIG. 1, and the terms "longitudinal" and "transverse" will refer to directions along lines B—B and C—C, respectively, in FIG. 1.

Referring now to the two side members 13 and 14, each of these members includes a large elongated rectangular opening in its upper portion which extends along almost the entire longitudinal dimension of the side member. Fixedly embedded by suitable retention means (not shown in detail) in the rectangular openings in each of the side members are identical transparent windows 18 and 19. These two opposing transparent windows allow for a full viewing from either side of the machine 10 of the activities taking place inside the housing 11. The side members 13 and 14 also each include four longitudinally spaced apart, crescent-shaped slots, the four crescent-shaped slots in side member 13 being labeled 13*a*, 13*b*, 13*c* and 13*d* in FIG. 1 and three of the four crescent-shaped slots in side member 14 being labeled 14*a*, 14*b* and 14*c* in FIG. 2. Each crescent-shaped slot in side member 14 is aligned transversely of the housing 11 with a corresponding crescent-shaped slot in side member 13, such that four sets of aligned crescent-shaped slots are created.

Portions of the game machine activator elements will be reciprocatingly movable within these sets of aligned crescent-shaped slots as suggested in FIG. 1. The side members 13 and 14 will also each include four control rod mounting brackets, the four control rod mounting brackets in side member 13 being labeled 13*e*, 13*f*, 13*g* and 13*h* in FIG. 1 and two of the four control rod mounting brackets in side member 14 being labeled 14*e* and 14*f* in FIG. 2. Each control rod mounting bracket in side member 14 is aligned with a corresponding control rod mounting bracket in side member 13, such that four sets of aligned control rod mounting brackets are created. Each set of aligned control rod mounting brackets will be functionally related to a respective set of aligned crescent-shaped slots, i.e., since the game machine activator elements which will reciprocatingly move in the aligned sets of the crescent-shaped slots will include (as discussed in further detail below) two control rods that will each have an end for mounting in a separate control rod mounting bracket in the respective side member. The side members 13 and 14 also include six bottom openings (not shown in FIG. 1) located near their bottom side edges, each bottom opening in side member 14 being aligned transversely of housing 11 with a corresponding bottom opening in side member 13 so as to create six sets of aligned bottom openings. The two sets of aligned bottom openings which are respectively located closest to the end members 15 and 16 will each function to allow a portion of an associated projector element to rotatably extend therethrough, whereas the four intermediate sets of aligned bottom openings (each of these sets being centrally located below an associated set of aligned crescent-shaped slots) will each allow a portion of an activator element which is reciprocatingly movable in the aligned set of crescent-shaped slots thereover to rotatably extend therethrough. Further reference to the functions and positionings of the crescent-shaped slots, the control rod mounting brackets and the bottom openings is given below.

Figure 2:
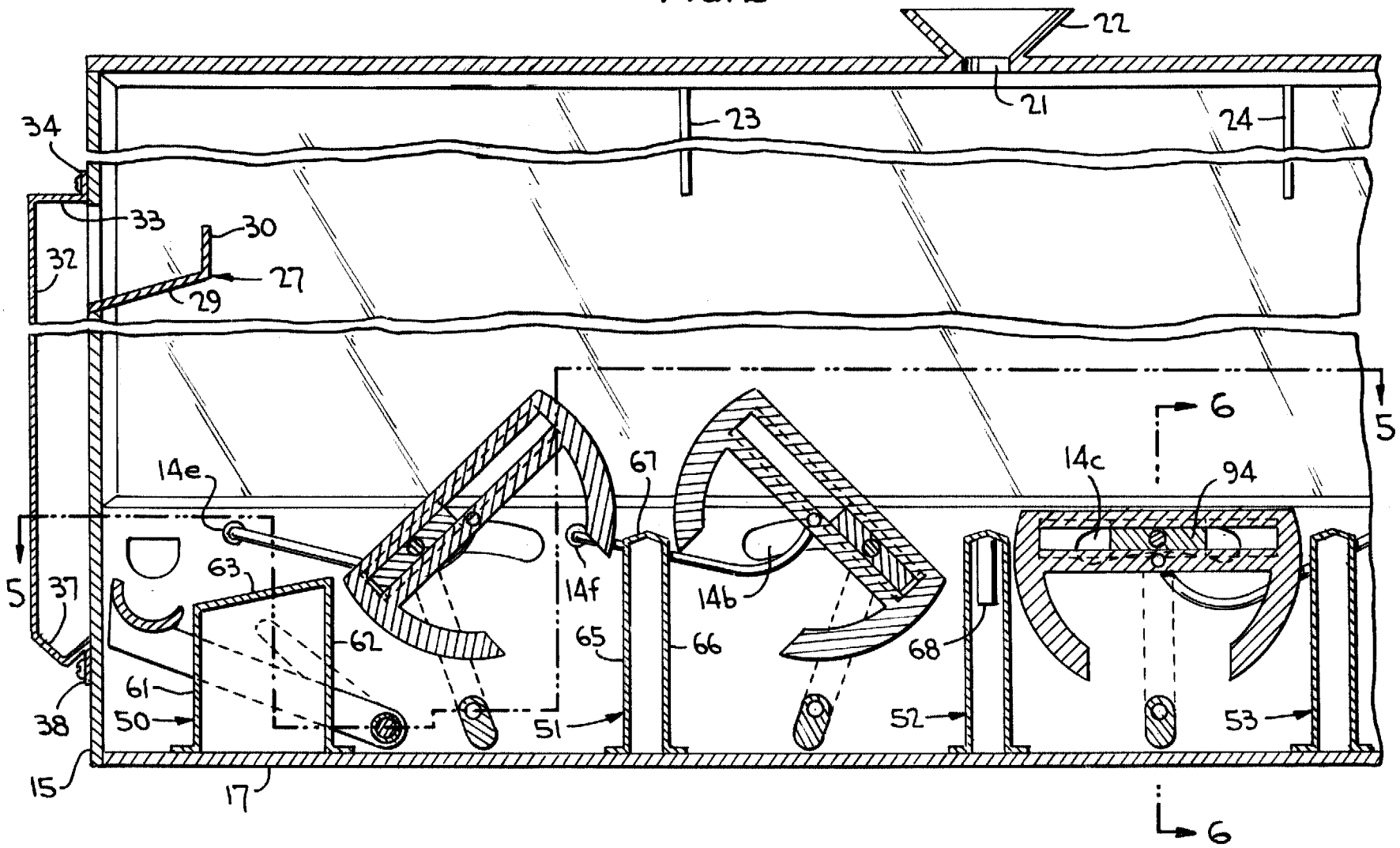
FIG. 2 shows a cross-sectional side view of the competition game device as seen along line 2—2 of FIG. 1.

Referring now to the cover member 12 of housing 11, it can be seen from FIG. 2 that it includes at the center thereof a circular opening 21, and fixedly attached to the outer side of cover member so as to extend upwardly from the rim of opening 21 is a funnel 22. This funnel 22 acts to help direct a game ball through opening 21 and into play inside of housing 11. At the same time, attached to extend downwardly from the inner side of cover member 12 in a fashion so as to be oriented transversely of the housing 11 are two identical baffle elements 23 and 24, these elements being spaced apart in the longitudinal direction of housing 11 and symmetrically positioned on opposite sides of the opening 20. These baffle elements act to interfere with the trajectory of a game ball which hits the sides of either element during operation of the machine.

As can be appreciated from a review of FIGS. 1 and 2, each of the end members 15 and 16 (which are identical in construction) includes a rectangularly-shaped opening 25 in its upper portion (the smallest dimension of each opening 25 being larger than the largest game ball which can be introduced into housing 11 through opening 20), and attached to the end members so as to extend within housing 11 are identical goal means 27 and 28. As shown in FIG. 2, which shows only the left-hand goal means 27, each goal means includes a floor portion 29 and a rim portion 30. The floor portion is mounted along one side to the adjacent end member along the lower edge of opening 25 so as to extend with an upward inclination within the housing 11, and the rim portion 30 is attached along one side to the opposite (upper) edge of the floor portion 28 so as to extend generally vertically upwardly within the housing.

Cooperable with the openings 25 in each end member 15 and 16 are identical game ball return means 31 and 41 which are respectively mounted on the outer sides of the two respective end members. As can be seen from FIGS. 1, 2 and 5, which show in detail only the game ball return means 31, each return means includes a backstop wall 32, a top wall 33, a perpendicular mounting flange 34, opposed lateral walls 35 and 36, a bottom return trough 37, and a perpendicular mounting flange 38. The top wall 33, the lateral walls 35 and 36 and the return trough 37 are all of a sufficient size to assure that the distance between the backstop wall 32 and the adjacent end member will be greater than the largest possible game ball diameter, and the return means will be mounted on the adjacent end members via flanges 34 and 38 (the connection means being shown but not labeled) such that the opening 25 in the adjacent end wall will open internally of the respective return means.

The return trough 37 is shown in FIG. 2 to have a V-shaped cross section. One end of the trough is connected to a V-shaped lower end of lateral wall 36, while a portion of the outer side of the trough is connected to the lower edge of the backstop wall 32 and an intermediate portion is connected to the lower end of lateral wall 35 (see FIG. 1). The trough can be seen to also include a cup-shaped end portion 39 which extends laterally beyond the lateral wall 34. The return trough is fashioned so as to be inclined downwardly to a slight extent between its end connected to lateral wall 36 and its cup-shaped end portion 39 which extends beyond lateral wall 35. At the same time, the lateral wall 35 includes a curved indentation 40 (see FIG. 1) at the lower end thereof. Thus, a game ball which has been projected into the goal means 27 and has rolled down inclined floor portion 29 to pass through the opening 25 in the adjacent end member, will fall through the associated return means and land on the return trough 37, and thereafter roll along the return trough 37 through indentation 40 in the lateral wall 35 and finally lodge in the cup-shaped end portion 39 for easy retrieval.

Of course since the return means 31 and 41 are mounted on opposite end members 15 and 16 of housing 11, the respective cup-shaped end portions 39 thereof will extend in opposite transverse directions and respectively act to return game balls to players positioned on opposite sides of the machine.

Turning now to a further consideration of the structure inside of housing 11, stationarily mounted to project upwardly from bottom member 17 in a fashion so as to be oriented transversely of housing 11 are five separate flooring panels, these flooring panels being located in spaced apart fashion between the housing end members 15 and 16. The uppermost portions of these flooring panels act to form separated segments of the floor (or playing deck surface) for the game ball within the housing 11. The five flooring panels include two outer flooring panels 50 and 54, a middle flooring panel 52, and two intermediate flooring panels 51 and 53. The outer flooring panels 50 and 54 are longitudinally positioned within housing 11 so as to be respectively located at equivalent predetermined distances from the end members 15 and 16, the middle flooring panel 52 is positioned at the midway point between the outer flooring panels (and thus at the longitudinal midpoint of the housing 11), the intermediate flooring panel 51 is positioned at the midway point between the outer flooring panel 50 and the middle flooring panel 52, and the intermediate flooring panel 53 is positioned at the midway point between the middle flooring panel 52 and the outer flooring panel 54.

Referring to the specific details of the construction of the flooring panels, as indicated in FIG. 2, which shows only the outer flooring panel 50, each outer flooring panel includes a first side wall 61, a second side wall 62 and an integral interconnecting top wall 63. The side wall 62 extends upwardly from the housing bottom member 17 a somewhat greater distance than does side wall 61, such that the interconnecting top wall 63 slopes downwardly from side wall 62 to side wall 61. Thus, any game ball rolling or bouncing thereon will tend to move towards end member 15. In addition, as can be seen from FIG. 5, the outer flooring panel 50 extends in the transverse direction of housing 11 an amount less than the full distance between side members 13 and 14, i.e., so as to leave small clearances X and Y (which are equal) between its respective ends and the adjacent side members 13 and 14, these small clearances being narrower than the diameter of any game ball that is expected to be used in housing 11. The outer flooring panel 54, although identical in construction to end flooring panel 50, is reversed in orientation within housing 11, such that any game ball rolling or bouncing on the top wall 63 thereof will tend to move towards end member 16. As depicted in FIG. 2, the preferred configuration for the top wall 63 of each end flooring panel is flat; however, it is obvious that in other embodiments of the invention different configurations of top wall 63 could also be used.

As shown in FIG. 2, each of the intermediate flooring panels 51 and 53, which are identical in construction, includes a first side wall 65, a second side wall 66 and an integral interconnecting top wall 67. The side walls 65 and 66 (which in the preferred embodiment of the invention are more closely spaced apart than are the side walls 61 and 62 of outer flooring panels 50 and 54) extend upwardly from the housing bottom member 17 an equal distance, this distance being somewhat greater than the distance side walls 62 of outer flooring panels 50 and 54 extend upwardly from bottom member 17. The top wall 67 is configured to have an upwardly projecting center portion, and as shown in FIG. 2 the preferred configuration for the top wall 67 is that of an inverted V-shape (in cross-section). Also, similarly to the outer flooring panels 50 and 54, the intermediate flooring panels 51 and 53 extend in the transverse direction of housing 11 an amount which is less than the full distance between side members 13 and 14, i.e., so as to leave small clearances X and Y (which are equal) between their respective ends and the adjacent side members 13 and 14 (these clearances being equal to the clearances X and Y between the respective ends of the outer flooring panels 50 and 54 and the side members 13 and 14).

The middle flooring panel 52 is constructed almost identically to the intermediate flooring panels 51 and 53, except that it will include two spaced apart bores 68 extending vertically downwardly from its top wall, these bores 68 being capable of mounting spaced apart support elements of a frame mounting a rectangular game net (not shown) which can optionally be employed in housing 11. On the other hand, unlike the outer flooring panels 50 and 54 and the intermediate flooring panels 51 and 53, the middle flooring panel 52 can be elongated to extend the full distance between the side members 13 and 14, i.e., since no clearances between the ends thereof and the side members 13 and 14 are needed.

As can be best appreciated from FIG. 2, the four sets of aligned crescent-shaped slots in the side members 13 and 14 will in fact be positioned along the longitudinal dimensions of side members 13 and 14 so as to be centrally located with respect to the spacings between the flooring panels located inside the housing 11; thus, the aligned crescent-shaped slots **13*a* and 14*a* in side walls 13 and 14 will be centrally located with respect to the spacing between the outer flooring panel 50 and the intermediate flooring panel 51 inside of housing 11, the aligned crescent-shaped slots 13*b* and 14*b* in side walls 13 and 14 will be centrally located with respect to the spacing between the intermediate flooring panel 51 and middle flooring panel 52 inside of housing 11, the aligned crescent-shaped slots 13*c* and 14*c* in side walls 13 and 14 will be centrally located with respect to the spacing between the middle flooring panel 52 and the intermediate flooring panel 53 inside of housing 11, and the crescent-shaped slot 13*d* in side wall 13 and the aligned crescent-shaped slot (not shown) in side wall 14 will be centrally located with respect to the spacing between the intermediate flooring panel 53 and the outer flooring panel 54 inside of housing 11. The sets of aligned bottom openings located in side members 13 and 14** which are positioned centrally below the sets of aligned crescent-shaped slots will likewise be positioned centrally with respect to the spacings between the noted flooring panels.

Turning now to a consideration of the movably mounted manipulation devices which are utilized in the inventive competition game machine, as can be surmised from FIGS. 1 and 2, these manipulation devices include two sets of activator elements 80, 82 and 81, 83, and two projector elements 130 and 131 (which projector elements are located at opposite ends of housing 11). One set of activator elements 80, 82 and one projector element 130 are operable by a game player (or players) positioned on one longitudinal side of the competition device 10, whereas the other set of activator elements 81, 83 and the other projector element 131 are operable by a game player (or players) positioned on the opposite side of the device 10. The manipulation devices not only act to move a game ball within housing 11 towards the opposite goal means when manipulated by the game players, but portions thereof will also form the remaining segments of the playing deck surface inside of housing 11; a portion of projector element 130 forming a segment of the playing deck surface between housing end member 15 and other flooring panel 50, a portion of activator element 80 forming a segment of the playing deck surface between the outer flooring panel 50 and the intermediate flooring panel 51, a portion of activator element 81 forming a segment of the playing deck surface between the intermediate flooring panel 51 and the middle flooring panel 52, a portion of activator element 82 forming a segment of the playing deck surface between the middle flooring panel 52 and the intermediate flooring panel 53, a portion of activator element 83 forming a segment of the playing deck surface between the intermediate flooring panel 53 and the outer flooring panel 54, and a portion of projector element 131 forming a segment of the playing deck surface between the outer flooring panel 54 and the end member 16.

Figure 3:
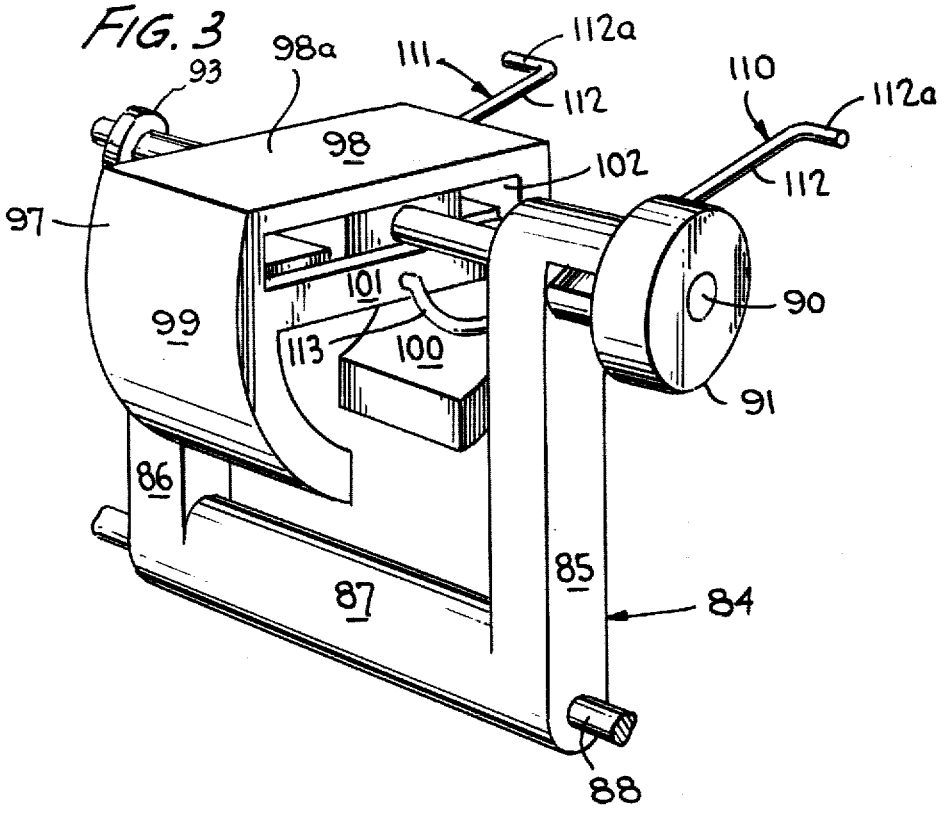
FIG. 3 shows a perspective view of a rotatable activator element used in the competition game device of FIG. 1.
Figure 7:
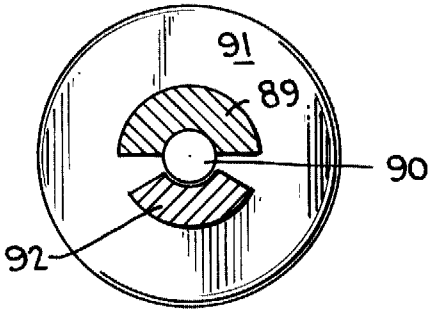
FIG. 7 shows a cross-sectional view of the activator element as seen along line 7—7 of FIG. 6.

Considering first the specific structure of the activator elements, as can be seen from FIG. 3, which shows a perspective view of a typical activator element (all the activator elements being identically constructed), each includes a unitary yoke 84 which is comprised of two parallel arms 84, 86 and a cross arm 87 that extends between corresponding first ends of the arms 85 and 86. A bore hole extends through the first ends of the arms 85, 86 and through the cross arm 87, and a rod 88 (around which the yoke 84 may be rotatable) projects therethrough. The second end of arm 85 includes a semi-circular projection 89 (see FIG. 7 which shows a detail of activator element 82) which extends perpendicularly to the length of arm 85 and outwardly of the yoke 84, and aligned bore holes are located in the second end of both arm 86 and in the second end of arm 85 (the bore hole in the second end of arm 85 forming a semi-circular bore at the center of the semi-circular projection 89). A shaft 90 rotatably extends through these aligned bore holes and is laterally fixed in position by an enlarged knob 91 rotatably connected to one end and a locking collar 93 fixedly connected to the opposite end. The knob 91 includes a curved projection 92 which extends towards arm 85 and is cooperable with the projection 89 from arm 85 to limit the rotation of shaft 90 with respect to the knob 91. Fixedly attached to the rotatable shaft 90 along a central portion thereof between the arms 85 and 86 is a control block 94 (see FIGS. 2, 6 and 7), the control block 94 including guides 95 and 96 perpendicularly extending away from opposite ends thereof. Slidingly mounted around the control block 94 is a contact member 97, this contact member functioning to both manipulate a game ball within housing 11 and act as a segment of the playing deck surface of housing 11.

Viewing the contact member 97 in more detail, it is seen to include a rectangular upper impact portion 98, two curved wing portions 99, 100, and a rectangular lower support portion 101. The two curved wing portions 99, 100 are integrally connected along their sides to opposite sides of the rectangular impact portion 98 so as to extend towards one another, and the rectangular lower support portion 101 is integrally connected along its opposite sides to the two curved wing portions so as to leave a uniform gap 102 between it and the rectangular upper impact portion 98 (see FIG. 2). The rectangular upper impact portion 98 includes a flat striking surface 98*a* which is capable of controlling the movement of a game ball which comes in contact therewith. The facing surfaces of the rectangular impact portion 98 and the lower support portion 101 includes opposing grooves (not labeled) which are cooperable with the guides 95 and 96 of control block 94 to maintain the contact member 97 in proper position around control block 94.

The contact member 97 also includes control rods 110, 111 attached to opposite ends thereof for connecting the contact member 97 to the side walls 13 and 14 of housing 11. As shown in FIGS. 2 and 3, each control rod includes a straight section 112 and a curved section 113. The free end of the control rod nearest curved section 113 includes a tip 113*a* (see FIGS. 5 and 6) for rotatable attachment to the lower support portion 101 of contact member 97 (at a point midway between the curved wing portions 99 and 100), and the free end of the control rod nearest the straight section 112 includes a tip 112*a* capable of rotatable attachment to a control rod mounting bracket in an adjacent housing side wall. The control rod 111 is constructed to be identical to control rod 110, except that the tips 112*a* and 113*a* will extend away from the length of the rod oppositely to the direction tips 112*a* and 113*a* extend away from control rod 110.

Figure 5:
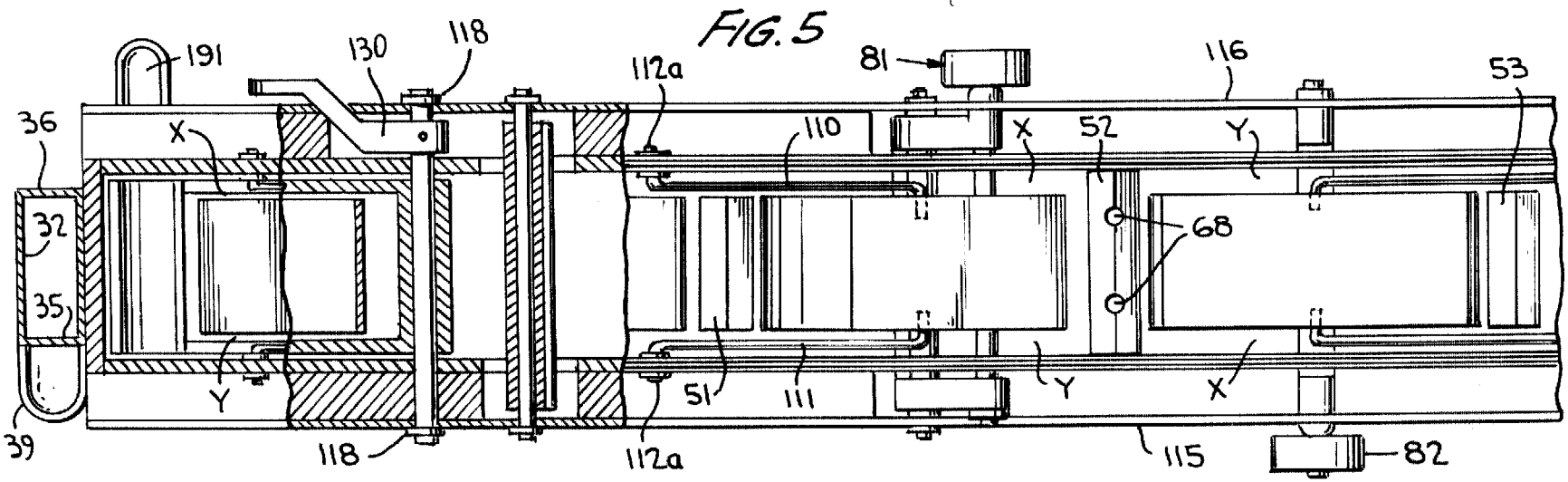
FIG. 5 shows a cross-sectional top view of the inventive competition game device as seen along line 5—5 of FIG. 2.
Figure 6:
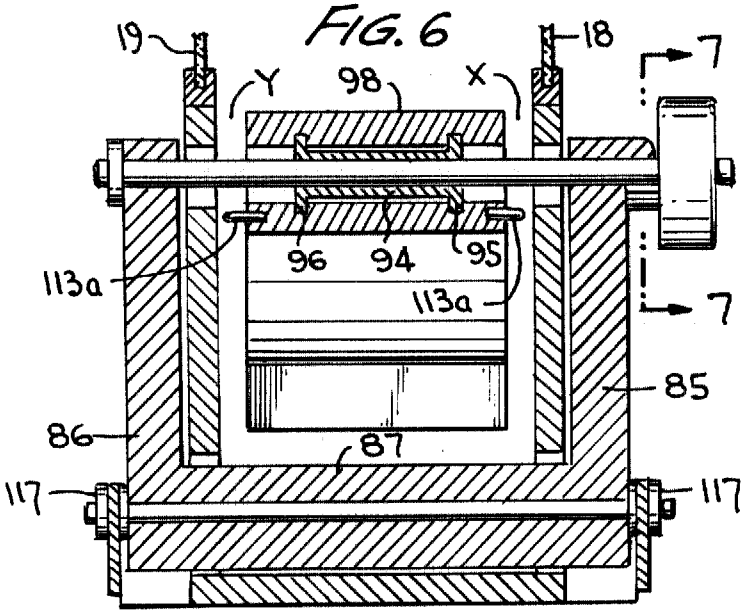
FIG. 6 shows a cross-sectional view of the competition game device as seen along line 6—6 of FIG. 2.

Further features of the activator elements can be seen from FIGS. 2, 5 and 6, which show further details of activator elements 80, 81 and 82, especially activator element 82. It can be seen that for each activator element the arm 87 of yoke 84 will extend in a rotatable fashion through a set of aligned bottom openings below an aligned set of crescent-shaped slots, and the arms 85 and 86 will be dimensioned to allow shaft 90 to fit within and be translatable along the associated aligned crescent-shaped slots. The contact member 97 will extend in a longitudinal direction to housing 11 such that the upper striking portion thereof, when horizontally oriented, will extend almost the full longitudinal distance between adjacent flooring panels, and in addition it will extend in a transverse direction of housing 11 so as to leave clearances X and Y (which are equal) between its ends and the side members 13 and 14. The control rod mounting elements in the side members 13 and 14 will be located such that the control rods 110 and 111 mounted therein at one end and at the other end in the contact member 97 will extend longitudinally of the housing 11 and be movable in the appropriate clearances X and Y. The knobs 91 of activator elements 80 and 82 will be positioned on the outer sides of side member 13, whereas the knobs 91 of activator elements 81 and 83 will be positioned on the outer sides of side member 14.

When the knob 91 of any activator element is manually gripped and moved, such that the associated shaft 90 translates in the associated crescent-shaped slots (the cross bar 87 of the associated yoke 84 rotating in the bottom openings therebelow), the control block 94 will move within gap 102 in contact member 97 and the contact member 97 will rotate (e.g. see rotational positionings of contact members 97 of activator elements 80 and 81 in FIG. 2), the contact member 97 all the while being prevented from longitudinal movement of any significance in housing 11 by the controlling action of the control rods 110 and 111 (the control rods, however, rotating in their associated mounting brackets to allow for slight vertical movement of the contact member). The aligned sets of control rod mounting brackets for each activator element will be located in the side members 13 and 14 such that the associated control rods will be moveable in clearances X and Y between the ends of adjacent flooring panels and side members as indicated in FIG. 2.

It can be appreciated from FIG. 2 that the curved wing portions 99 and 100 of contact member 97 will prevent a game ball from falling down below the playing deck surface when the contact member 97 is rotated.

The ends of the rods 88 of each of the activators 80, 82, 81 and 83 will be sufficiently elongated to extend through holes in retaining strips 115 and 116 (see FIGS. 1 and 5) which are respectively positioned in spaced-apart fashion from the outer sides of side members 13 and 14 by spacer blocks (not labeled). Locking nuts 117 are threadingly attached to the ends of each of the rods 88 and against the adjacent retaining strips to keep the respective rods suitably positioned transversely of the housing 11.

Figure 4:
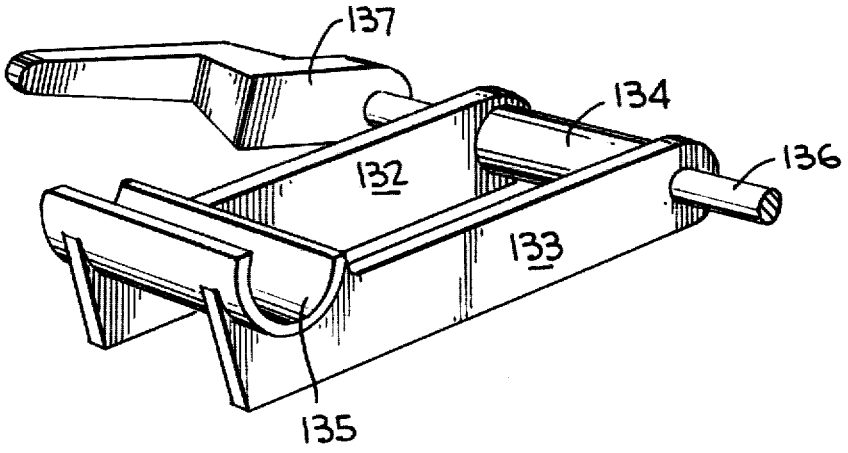
FIG. 4 shows a perspective view of a rotatable projector element used in the competition game device of FIG. 1.

Considering now the specific structure of the projector elements, as can be seen from FIG. 4, which shows a perspective view of a typical projector element (each of the projector elements being identical), each includes two parallel legs 132 and 133, a cross member 134 which interconnects the corresponding first ends of the parallel legs, and a curved head portion 135 which interconnects the corresponding second ends of the parallel legs. A shaft 136 extends through the hollow cylindrical cross member 134 (and is fixedly connected thereto), and a handle 137 is fixedly attached to the shaft 136 near one end.

Referring to FIGS. 2 and 5, which specifically show only the projector element 130, it can be seen that it is positioned such that the shaft 136 will extend through the aligned set of bottom openings in side members 13 and 14 closest to end member 15 (this set of bottom openings being longitudinally positioned along side members 13 and 14 beyond the longitudinal positioning of outer flooring panel 50), and the handle 137 is located outside of housing 11 adjacent side member 14. The projector element is dimensioned such that the parallel legs 132, 133 will be movable in the clearances X and Y between the ends of outer flooring panel 50 and the housing side walls 13 and 14, and when the projector element is in its rest position the curved head portion 135 will form a playing deck segment between the upper end of side wall 61 of outer flooring panel 50 and the end member 15. Retaining rings 118 are attached to the ends of shaft 136 on the outer sides of retaining strips 115 and 116.

The projector element 131 is identical to projector element 120 except that it is reversed in orientation in housing 11. The shaft 136 thereof will extend through the aligned set of bottom openings in side members 13 and 14 closest to end member 16, and the curved head portion thereof will form a playing deck surface between the upper end of side wall 61 of outer flooring panel 54 and the end member 16, i.e., when the projector element 131 is in its rest position.

The projector elements 130 and 131 function to allow the competing game players to project towards the goal means of the opposing player (or players) a game ball which is located in curved head portions thereof, the game ball having arrived there either by rolling down the top walls of the adjacent outer flooring panels or by landing directly thereon from above.

It should be noted that abutment stops (such as stops 180 and 181 shown in FIG. 1) can be suitably attached to the outer sides of the side members 13 and 14, if desired, to help limit the rotational movement of the yoke portions of the various activator elements and the handles of the two projector elements to the extent desired. Also, the side members 13 and 14 can also include respective openings therein with cup-shaped entry troughs 190 and 191 attached to the outer sides for introduction of a game ball into the competition game machine as an alternative to the dropping of a game ball through opening 21 in the center of cover member 12. These entry channels will be suitably located to allow the game ball to be introduced into the game machine so as to roll upon the curved head portions of the adjacent projector elements.

Depending on the particular game desired to be played within housing 11, a net may be positioned transversely across housing 11 to alter the ways in which movement of a game ball from one end of the game machine to the other can be achieved. As noted previously, the frame for such a net can be attached to the middle flooring panel 52, e.g., after the cover member 12 of housing 11 has been disconnected and removed from attachment to the side and end members of the housing.

Figure 8:
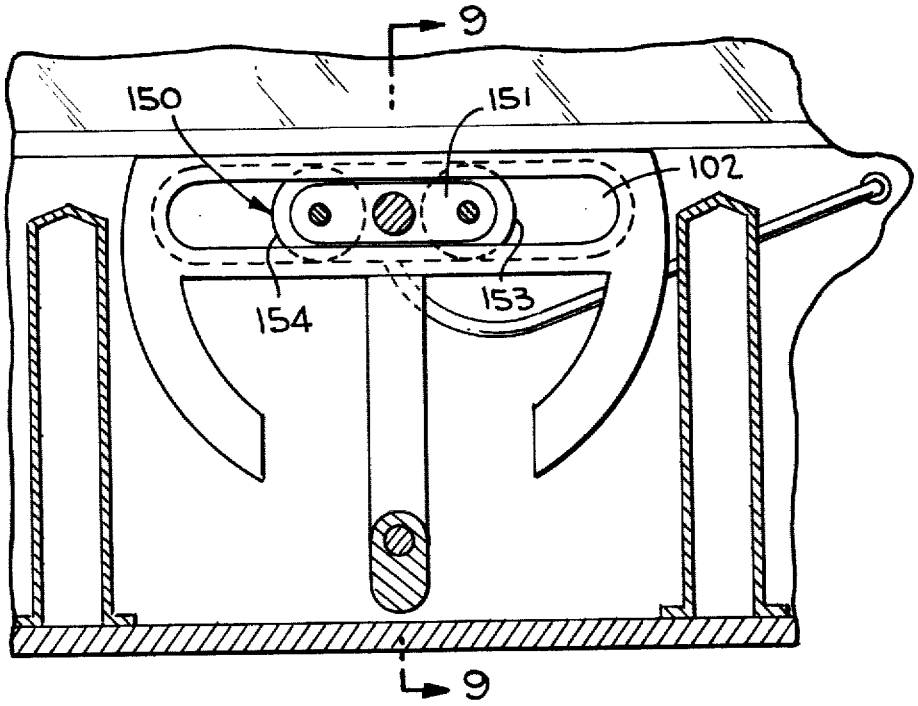
FIG. 8 shows a partial cross-sectional side view of the inventive competition game device showing an alternative construction of activator element for use therein.
Figure 9:
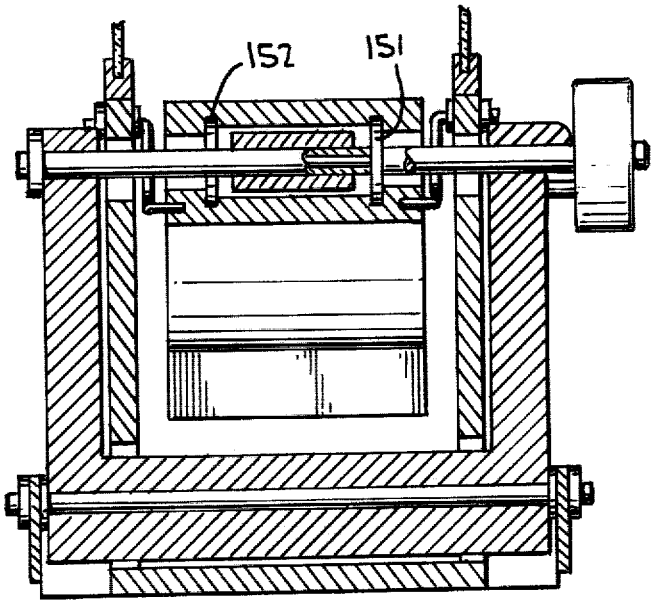
FIG. 9 shows a cross-sectional view of the competition game device as seen along line 9—9 of FIG. 8.

Turning now to FIGS. 8 and 9 which show cross-sectional views of an alternative configuration of activator element for use in the competition game machine constructed in accordance with the present invention, and more particularly to an alternative mode of sliding relationship between the shaft 90 and the contact element 97 of an activator element, it can be seen that the slidable control block 94 attached to the shaft 90 of the activator element has been replaced with a carriage 150 which comprises two spaced-apart support members 151, 152, and two rollers 153, 154 rotatably connected between corresponding ends of the support members. The shaft 90 of the activator element extends through openings in the center portions of each support members at a point between the rollers 153, 154. The spaced apart support members will fit within the grooves in the facing surfaces of the upper impact portion 98 of the contact member 97 and the lower support portion 101, and the rollers 153, 154 will be dimensioned to allow their easy movement with gap 102.

When two (or more) players operate any of the competition game machine embodiments of the present invention, various modes of play can be followed; however, in each mode the object will be to project the game ball into the opponent's goal means by suitably hitting, tossing and/or bouncing the game ball within housing 11. Such actions will be achieved by a player's utilization of his activator and projector elements. Certain further features of the inventive game machine and basic criteria of operation and play are as follows.

A player can use his own projector element to project a game ball towards the opponent's goal means. This can take place when the game ball has been introduced into the housing by means of the associated entry channel on the adjacent side member of housing 11 or when the game ball falls or rolls onto the curved head portion of the projector element. The projecting action of the projector element, which occurs by gripping and rotating handle 137, can take place either immediately upon location of the game ball in the curved head portion, or after an interval of time.

The projector element can thus give the player the advantage of the exact timing, velocity and arc of his projecting of the game ball towards the opponent's goal means. At the same time, it requires skill in getting the game ball past the opponent's activator elements (which elements can be positioned by the opponent to deflect or intercept the toss), in projecting the game ball so that it can be controlled by the player's own activator elements, and in projecting the game ball so as to avoid contact with the baffle plates.

On the other hand, the opposing player should be operating his activator elements to take control of the game ball and project it towards the other player's goal means.

Each rotatable activator element provides for a control in catching, holding, throwing and/or striking the game ball.

Although two embodiments of the competition game machine of the present invention have been described in detail in the foregoing description and discussion, it will be apparent that many changes and modifications thereto could be made and the game machine would still fall within the scope of the appended claims.

We claim:

1. A competition game machine which comprises, (a) an elongated housing formed by a cover member, two side members, two end members and a bottom member, said side members including openings therein in which are mounted window elements; said cover member including an opening in the center thereof to allow a game ball to be dropped into said housing, each of said side members including at least two crescent-shaped slots therein, the crescent-shaped slots in one side member being transversely aligned with the crescent-shaped slots in the other side member, said side members also including transversely aligned bottom openings therein near the lower sides thereof, and each of said end members including an opening in the upper portion thereof which is sufficiently sized to allow a game ball to pass therethrough, (b) identical game ball return means mounted on the outer sides of each respective end member and capable of receiving a game ball passing through the opening in the respective end member, (c) at least three transversely extending flooring panels mounted in said housing in spaced apart fashion between said housing end members, the upper portions of said flooring panels forming segments of a game ball playing deck surface above the housing bottom member, (d) separate identical projector elements positioned near the opposite end members of the housing, each projector element including a transversely extending curved head portion which, when the projector element is in its rest position, will form a segment of the playing deck surface between the adjacent housing end member and the nearest flooring element, and which, when the projector element is operated, will project a game ball therein towards the opposite end member of the housing, each projector element also including a rotatable projector shaft to which the curved head portion is connected, said rotatable projector shaft extending through transversely aligned bottom openings in said housing side members and having a handle means attached near one end thereof outside said housing to allow for manual gripping thereof and rotation of said rotatable projector shaft, the handle means of the separate projector elements being on the outer sides of opposite side members, (e) at least two separate and identical activator elements positioned in the housing between said separate projector elements, each said activator element including a transversely extending rotatable contact member which forms a segment of the playing deck surface between adjacent flooring panels and, when rotated, acts to control the movement of a game ball in contact therewith, each activator element also including a yoke having two arms and a cross bar connecting first ends of said arms, said cross bar being rotatably mounted in aligned bottom openings in said housing side members, the second ends of said arms including aligned bores through which extends a rotatable activator shaft, each said rotatable activator shaft extending through and being translatable within transversely aligned crescent-shaped slots in said housing side walls and including a knob rotatably connected near one end at a point outside of said housing, the knobs on adjacent activator elements being on the outer sides of opposite side members, the contact member of each activator element being mounted around a center portion of the associated rotatable activator shaft between said housing side members, said contact member having control means connected between opposite ends thereof and the adjacent housing side members, said control means allowing said contact member to rotate along an axis transverse to said housing when the rotatable activator shaft is slidingly moved therethrough by manual translation of the rotatable activator shaft along said aligned crescent-shaped slots, yet prevent substantial longitudinal movement of said contact member within said housing.

2. A competition game machine as defined in claim 1 wherein each of said housing end members includes a means forming a goal on the inner side thereof which is capable of feeding a rolling game ball projected therein through the opening in the adjacent end member, each said goal means including a floor portion connected along one side to the adjacent end member along the lower edge of the opening therein and a rim portion connected to the opposite side of said floor portion so as to extend generally upwardly within said housing.

3. A competition game machine as defined in claim 2 wherein each said game return means includes a bottom return trough which includes a cup-shaped end portion, the bottom return trough being inclined so as to cause a game ball thereon to roll to said cup-shaped end portion for easy retrieval by the respective game machine player.

4. A competition game machine as defined in claim 1 wherein each contact member of each activator element includes an upper impact portion, two curved wing portions which are connected along their sides to opposite sides of said upper impact portion to extend towards one another, and a lower support portion which is connected between said two curved wing portions to leave a gap between the lower support portion and the upper impact portion, the center portion of the rotatable activator shaft of each activator element including a means connected thereto which is slidable within said gap in the associated contact member.

5. A competition game machine as defined in claim 4 wherein each said means connected to the center portion of each rotatable activator shaft is a block means.

6. A competition game machine as defined in claim 4 wherein each said means connected to the center portion of each rotatable activator shaft is a carriage comprising two spaced apart support elements and two rollers mounted between said support elements, the associated rotatable activator shaft extending through openings in said support members to be centrally located between said rollers.

7. A competition game machine as defined in claim 4 wherein each control means connected between the respective ends of each contact member and the adjacent housing side wall comprises a contoured control rod; wherein one end of each contoured control rod is rotatably connected to the lower support portion of the adjacent end of a contact member at the midpoint between the two curved wing portions; and wherein the second end of each contoured control rod is rotatably connected to a control rod mounting bracket in the adjacent housing side wall.

8. A competition game machine as defined in claim 7 wherein five equally spaced apart flooring panels are positioned in said housing and wherein four equally spaced apart activator elements are utilized in said game machine, the housing side walls including four sets of aligned crescent-shaped slots located centrally of the spaces between the flooring panels inside the housing, the housing side walls also including six sets of aligned bottom openings near the lower side thereof, four sets of which are centrally located beneath the four sets of aligned crescent-shaped slots.

9. A competition game machine as defined in claim 8 wherein the two flooring panels located nearest each housing end member extend transversely of the housing a distance less than the distance between the housing side members to leave clearances therebetween; wherein the activator contact elements extend transversely of the housing a distance less than the distance between the housing side members to leave clearances therebetween; and wherein the respective contoured control rods connected to opposite ends of each contact member will be movable in said clearances.

* * * * *